US010465696B2

(12) United States Patent
Kim et al.

(10) Patent No.: US 10,465,696 B2
(45) Date of Patent: Nov. 5, 2019

(54) CENTRIFUGAL FAN

(71) Applicant: Samsung Electronics Co., Ltd., Gyeonggi-do (KR)

(72) Inventors: Hyun Joo Kim, Gyeonggi-do (KR); Kwang Su Heo, Gyeonggi-do (KR); Eung Ryeol Seo, Gyeonggi-do (KR); Hyo Suck Kang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 639 days.

(21) Appl. No.: 15/080,440

(22) Filed: Mar. 24, 2016

(65) Prior Publication Data

US 2016/0281731 A1 Sep. 29, 2016

(30) Foreign Application Priority Data

Mar. 24, 2015 (KR) ..... 10-2015-0040734

(51) Int. Cl.
*F04D 29/26* (2006.01)
*F04D 29/28* (2006.01)
(Continued)

(52) U.S. Cl.
CPC ..... *F04D 29/281* (2013.01); *F04D 29/263* (2013.01); *F04D 29/282* (2013.01);
(Continued)

(58) Field of Classification Search
None
See application file for complete search history.

(56) References Cited

U.S. PATENT DOCUMENTS

2007/0110573 A1* 5/2007 Lan ..... F04D 29/281 415/206
2007/0231141 A1* 10/2007 Chaing ..... F01D 5/048 416/185
(Continued)

FOREIGN PATENT DOCUMENTS

EP 0964161 A2 12/1999
FR 1280348 12/1961
(Continued)

OTHER PUBLICATIONS

Extended European Search Report dated Aug. 18, 2016 in connection with European Application No. 16161821.0, 7 pages.
(Continued)

*Primary Examiner* — Jessica Cahill
*Assistant Examiner* — Daphne M Barry

(57) ABSTRACT

Disclosed herein are a centrifugal fan and a refrigerator. The centrifugal fan according to an aspect of the present disclosure has a structure in which a plurality of blades disposed along a circumferential direction are disposed in two lines in a radial direction of a hub, such that the noise of the fan is reduced and the flow rate of air is increased, and the efficiency of the fan is improved, and the centrifugal fan includes a middle guide member inducing an inflow in the center of the fan, such that the inflow to the fan is prevented from being concentrated in a lower part of the fan, and a total height of a discharge port is efficiently used. Therefore, the uniformity of a component of a discharging flow at the discharge port is improved and thus the noise of the fan is reduced.

18 Claims, 16 Drawing Sheets

(51) Int. Cl.
*F04D 29/30* (2006.01)
*F04D 29/44* (2006.01)
*F04D 29/66* (2006.01)

(52) U.S. Cl.
CPC ..... *F04D 29/30* (2013.01); *F04D 29/442* (2013.01); *F04D 29/666* (2013.01); *F04D 29/667* (2013.01)

(56) References Cited

U.S. PATENT DOCUMENTS

| | | | | |
|---|---|---|---|---|
| 2013/0236303 | A1* | 9/2013 | Teramoto | F04D 17/08 415/206 |
| 2014/0157613 | A1 | 6/2014 | McLain | |
| 2017/0159662 | A1* | 6/2017 | Teramoto | F04D 17/16 |
| 2017/0224940 | A1* | 8/2017 | Kenyon | A61M 16/0066 |
| 2017/0298942 | A1* | 10/2017 | Kuno | F04D 17/10 |
| 2017/0298951 | A1* | 10/2017 | Itoh | F04D 29/284 |
| 2017/0321705 | A1* | 11/2017 | Leal | F04D 17/165 |

FOREIGN PATENT DOCUMENTS

| | | | |
|---|---|---|---|
| JP | 2005291577 | A | 10/2005 |
| JP | 2007-162467 | A | 6/2007 |
| TW | 200718868 | A | 5/2007 |

OTHER PUBLICATIONS

Office Action dated Jun. 7, 2018 in connection with Chinese Patent Application No. 201610173525.4.

Communication pursuant to Article 94(3) EPC dated Apr. 19, 2018 in connection with European Patent Application No. 16 161 821.0.

Patent Office of the People's Republic of China, "Notification of Fulfilling of Registration Formality," Application No. CN201610173525.4, dated Jun. 3, 2019, 5 pages.

* cited by examiner

CENTRIFUGAL FAN

CROSS-REFERENCE TO RELATED APPLICATION AND CLAIM OF PRIORITY

This application claims the priority benefit of Korean Patent Application No. 10-2015-0040734, filed on Mar. 24, 2015 in the Korean Intellectual Property Office, the disclosure of which is incorporated herein by reference.

FIELD

Embodiments of the disclosure relate to a centrifugal fan capable of reducing noise and increasing a flow rate of air.

BACKGROUND

Generally, centrifugal fans have been applied to various home appliances, such as refrigerators, air conditioners, and cooking devices.

A centrifugal fan includes a hub for fixing a rotation shaft of a motor, and a plurality of blades for discharging air introduced in an axial direction of the hub in a radial direction of the hub.

Recently, various studies have been conducted to reduce noise of a centrifugal fan while increasing flow rate.

SUMMARY

Therefore, it is an aspect of the present disclosure to provide a centrifugal fan configured to increase a flow rate of air and reduce noise.

Additional aspects of the disclosure will be set forth in part in the description which follows and, in part, will be obvious from the description, or may be learned by practice of the disclosure.

In accordance with one aspect of the present disclosure, a centrifugal fan includes a hub to which a rotation shaft of a motor is coupled, a shroud disposed facing the hub, a guide member disposed between the shroud and the hub to change a flow direction of air introduced in an axial direction of the hub to a circumferential direction of the hub, a plurality of first blades separated from each other and disposed along the circumferential direction of the hub, and a plurality of second blades disposed to be separated from each other along the circumferential direction of the hub, while disposed to be separated from the plurality of first blades in a radial direction of the hub.

A diameter of the hub may be smaller than an inner diameter of the guide member.

The guide member may include an inlet-side planar region into which air is introduced, an outlet-side planar region from which the air is discharged, and a curved surface region which connects the inlet-side planar region to the outlet-side planar region.

An angle of the inlet-side planar region of the guide member inclined with respect to a direction of the rotation shaft of the hub may be in the range of −20° to 45°.

The guide member may be connected to the hub by the plurality of first blades.

The guide member may be connected to the shroud by the plurality of second blades.

A diameter of an inlet of the guide member may be smaller than a diameter of the outlet of the guide member.

The diameter of the inlet of the guide member may be in a range of 20% to 80% of a total diameter of the centrifugal fan.

The diameter of the outlet of the guide member may be in a range of 30% to 90% of a total diameter of the centrifugal fan.

A height of an inlet of the guide member may be 120% or less of a total height of the centrifugal fan.

A height of an outlet of the guide member may be 90% or less of a height of an outlet of the centrifugal fan.

An outer diameter of the guide member may be smaller than an inner diameter of the shroud.

Each of the plurality of second blades may include one side and the other side with respect to the guide member, and the one side and the other side may be formed in different shapes from each other.

A code length of the one side may be formed to be greater than or equal to a code length of the other side.

An inlet angle of the one side and an inlet angle of the other side may be different from each other, and an outlet angle of the one side and an outlet angle of the other side may be the same.

In accordance with another aspect of the present disclosure, a centrifugal fan includes a hub to which a rotation shaft of a motor is coupled, a shroud disposed facing the hub, at least one guide member disposed between the shroud and the hub to change a flow direction of air introduced in an axial direction of the hub to a circumferential direction of the hub, and a plurality of blades disposed to be separated from each other along the circumferential direction of the hub.

A diameter of the hub may be smaller than an inner diameter of a guide member that is smallest among the at least one guide member.

Among the at least one guide member, an inner diameter of a shroud-side guide member may be formed to be greater than an outer diameter of a guide member of a hub-side among the at least one guide member.

The at least one guide member may be connected to the shroud or the hub by the plurality of blades.

An outer diameter of the at least one guide member may be smaller than an inner diameter of the shroud.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, problems of a conventional centrifugal fan will be reviewed, and exemplary embodiments according to the present disclosure will be described in detail.

Figure 1:
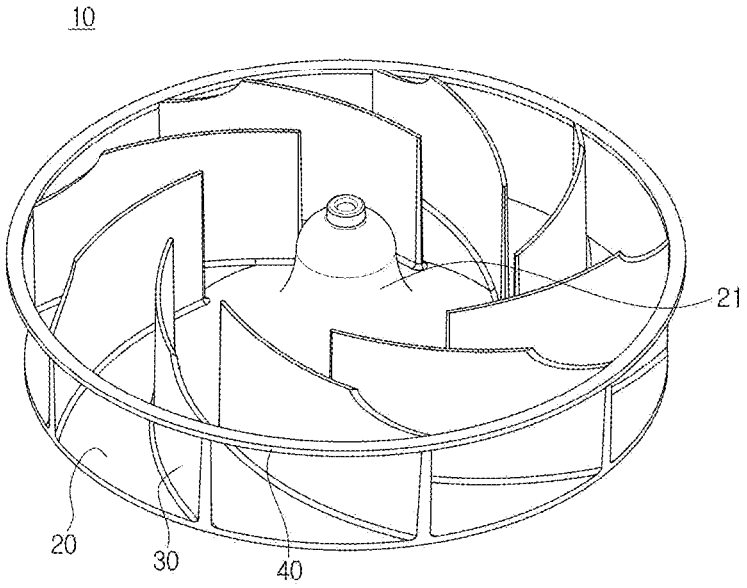
FIG. 1 is a perspective view illustrating an exterior of a conventional centrifugal fan when viewed from the top.

FIG. 1 is a perspective view illustrating a conventional centrifugal fan.

Referring to FIG. 1, a conventional centrifugal fan 10 may be formed including a disc-shaped base 20 to which a rotation shaft of a motor is coupled, a plurality of blades 30 configured to flow air introduced in an axial direction of the base 20 in a radial direction, and a shroud 40 configured to prevent air from eddying at an outlet in front of the plurality of blades 30.

A protruding hub 21 is provided at the center of the base 20 such that the rotation shaft of the motor is fixed, and the plurality of blades 30 are separated predetermined gaps and disposed along an edge of the base 20 in a circumferential direction of the base 20.

Shapes and installation angles of the blades of the centrifugal fan are determined to have an optimum efficiency in consideration of an angle formed with an axial velocity and a rotational velocity of introduced or discharged air flow, but since the air flow is concentrated on a lower part of the blades in the conventional centrifugal fan, angles of the air flow at an upper part of the blades and the lower part of the blades are greatly different, and thus inefficient air flow may occur.

In order to improve the inefficiency, shapes and installation angles of the upper part of the blades and the lower part of the blade should be different, for this blades in a three-dimensional shape may also be used. However, 3D blades are difficult to manufacture and cause an increase in the manufacturing cost.

In order to solve the above problems, one embodiment of the present disclosure discloses a structure in which a fan has a guide member inducing inflow in a middle part of the fan to prevent the inflow from being concentrated at a lower part of the fan so that total heights of the blades are effectively used, and which is easily manufactured in a mold.

Additionally, one embodiment of the present disclosure discloses a structure in which a dual blade structure is provided in a radial direction around a hub to increase the flow rate of air and to improve the uniformity of a component of a discharging flow, thereby reducing noise of the fan is disclosed.

Figure 2:
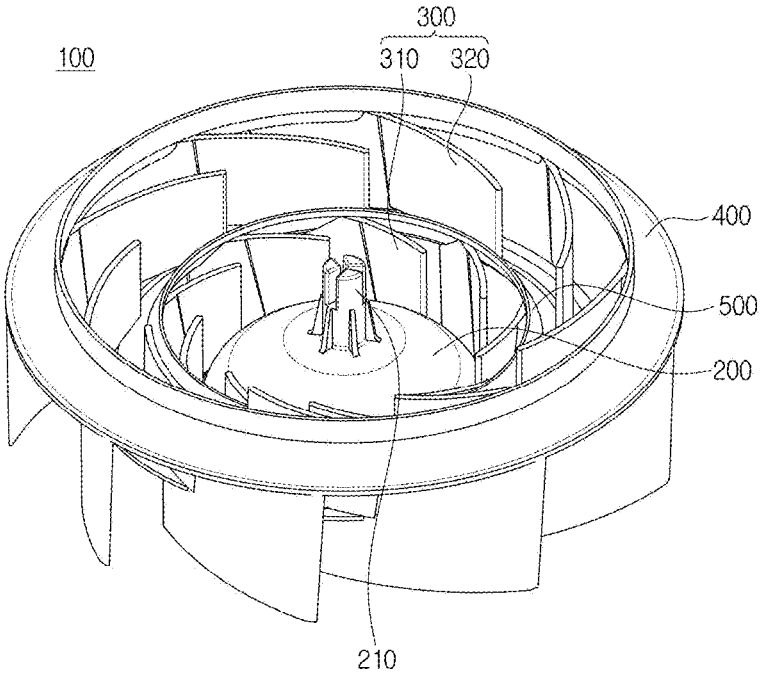
FIG. 2 is a perspective view illustrating an exterior of a centrifugal fan according to one embodiment of the present disclosure when viewed from the upper side.
Figure 3:
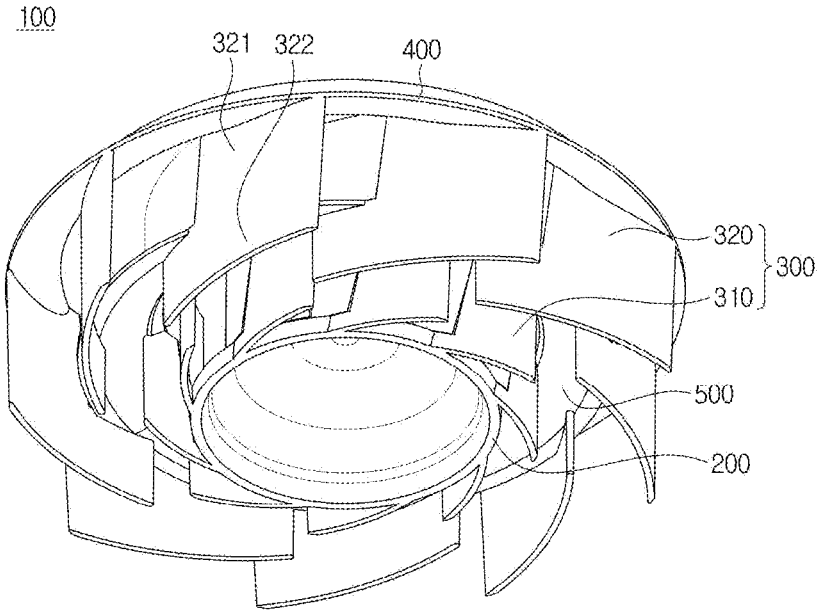
FIG. 3 is a perspective view of the exterior of the centrifugal fan shown in FIG. 2 when viewed from the bottom.
Figure 4:
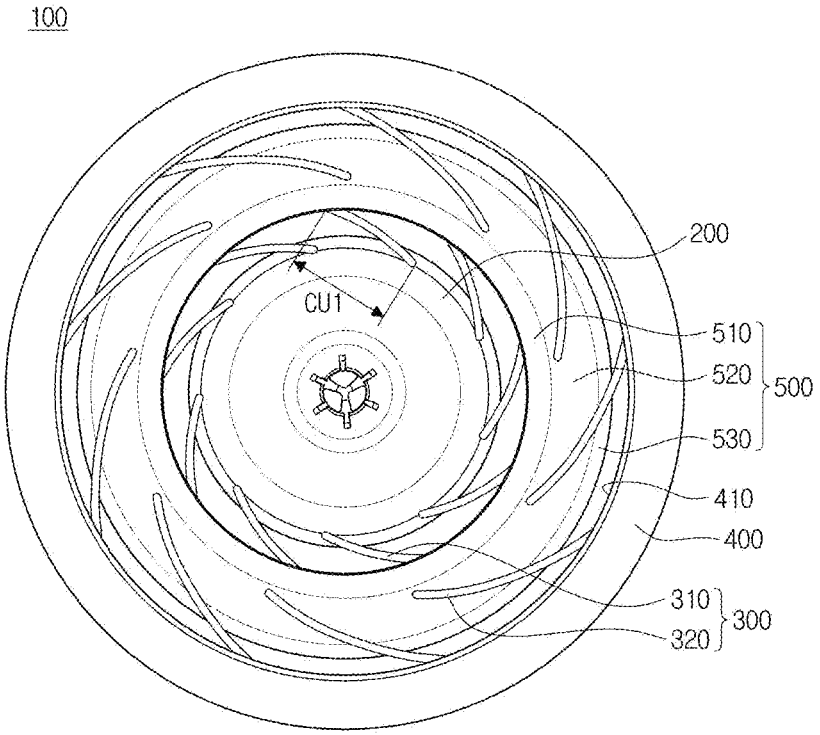
FIG. 4 is a plan view illustrating the centrifugal fan shown in FIG. 2.
Figure 5:
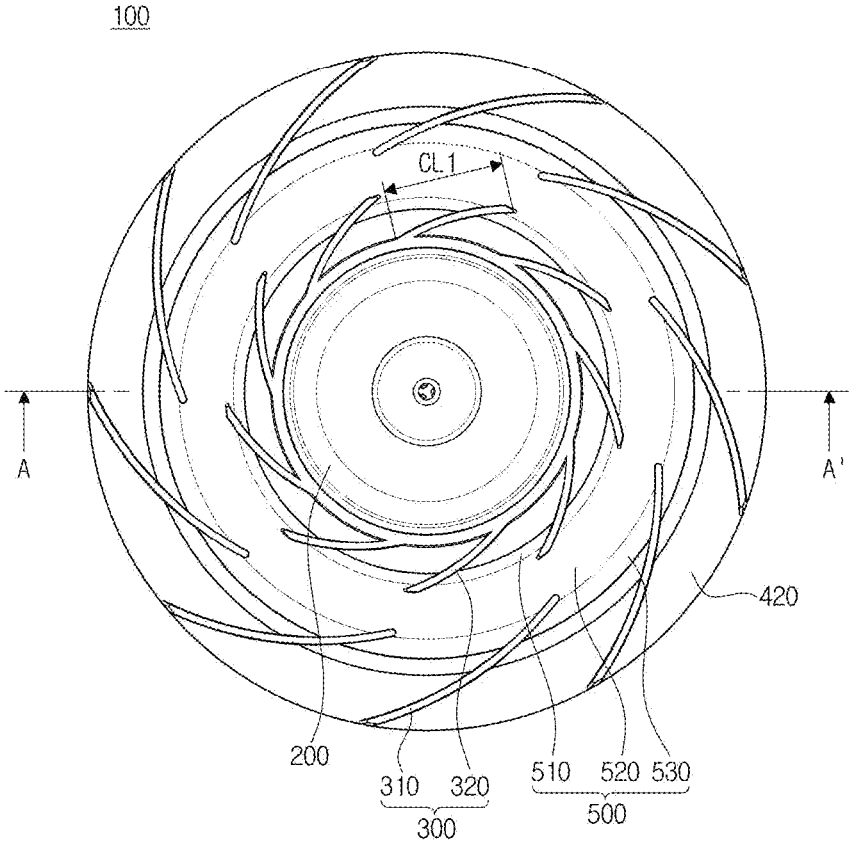
FIG. 5 is a bottom view illustrating the centrifugal fan shown in FIG. 2.
Figure 6:
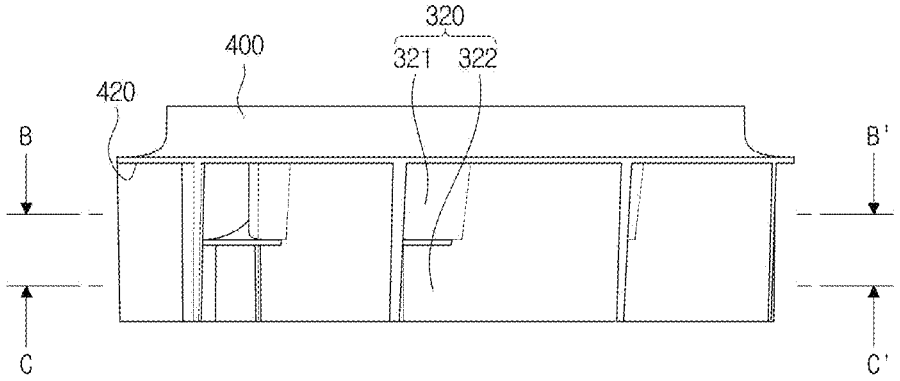
FIG. 6 is a side view illustrating the centrifugal fan shown in FIG. 2.
Figure 7:
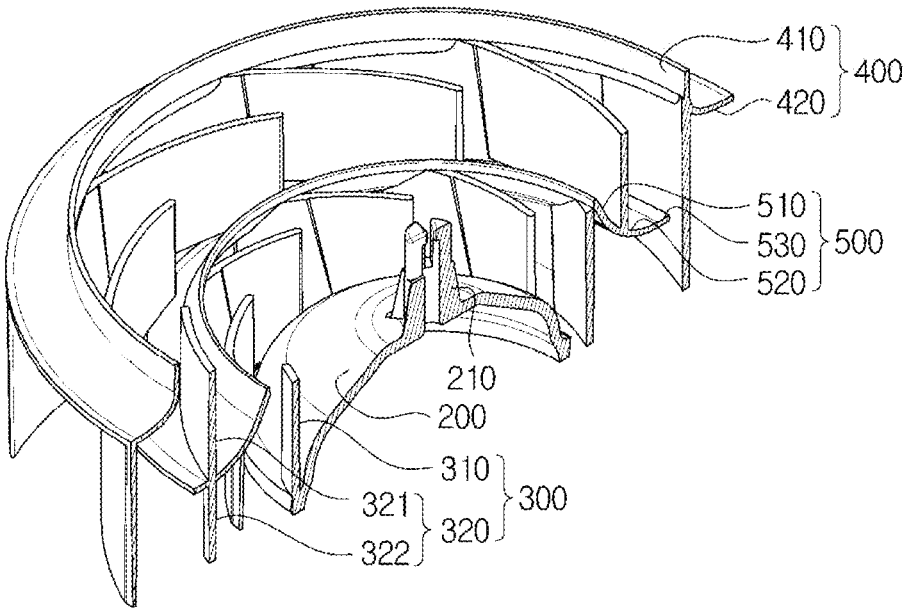
FIG. 7 is a perspective view illustrating the centrifugal fan taken along line A-A' of FIG. 5.
Figure 8:
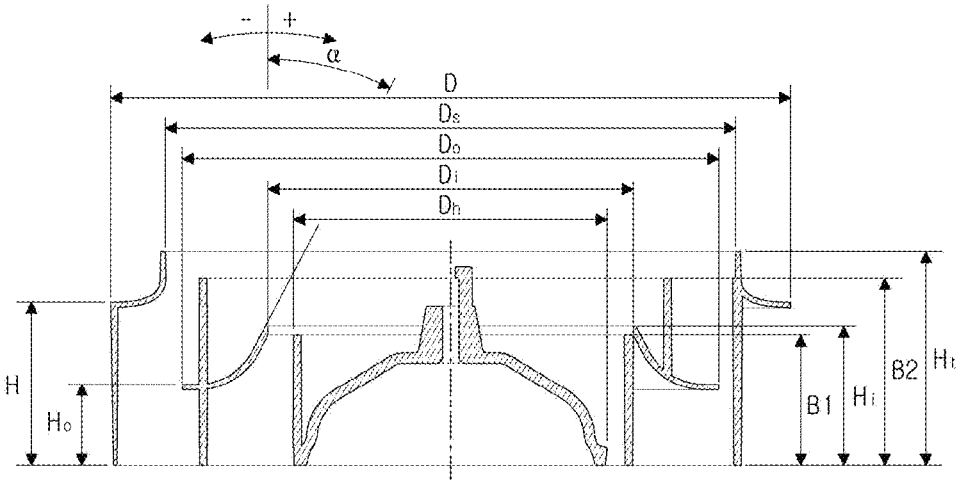
FIG. 8 is a side sectional view illustrating the centrifugal fan taken along line A-A' of FIG. 5.
Figure 9:
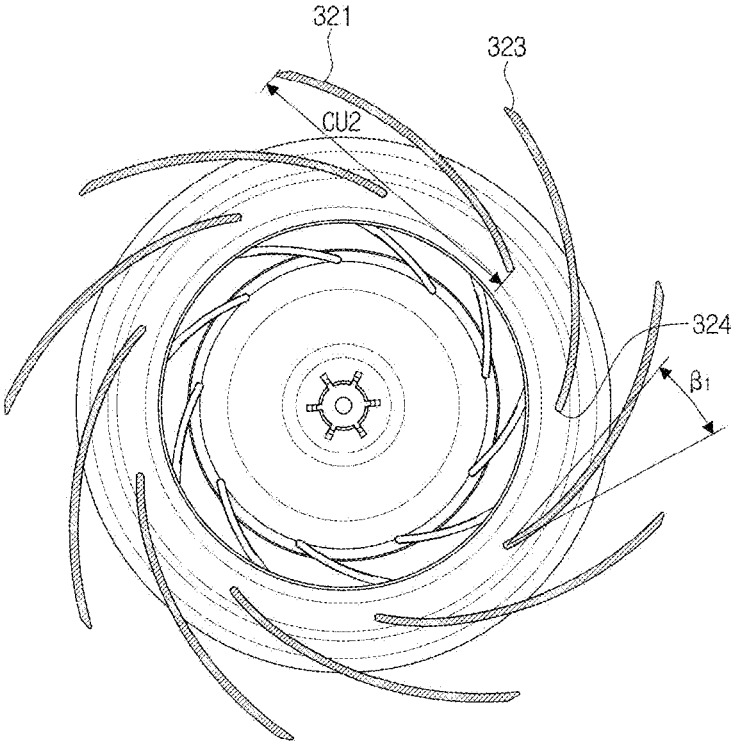
FIG. 9 is a plan sectional view illustrating the centrifugal fan taken along line B-B' of FIG. 6.
Figure 10:
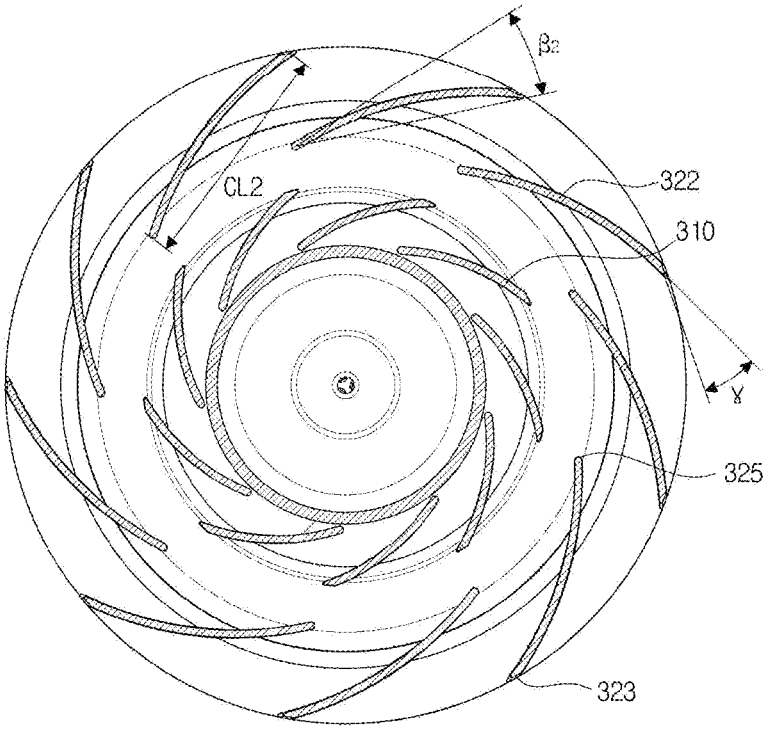
FIG. 10 is a plan sectional view illustrating the centrifugal fan taken along line C-C' of FIG. 6.

FIG. 2 is a perspective view of an exterior of a centrifugal fan according to one embodiment of the present disclosure when viewed from the top, and FIG. 3 is a perspective view of an exterior of the centrifugal fan of FIG. 2 when viewed from the bottom. FIG. 4 is a plan view of the centrifugal fan shown in FIG. 2, FIG. 5 is a bottom view thereof, and FIG. 6 is a side view thereof. FIG. 7 is a perspective view of the centrifugal fan taken along line A-A' of FIG. 5, and FIG. 8 is a side sectional view of the centrifugal fan taken along line A-A' of FIG. 5. FIG. 9 is a plan sectional view of the centrifugal fan taken along line B-B' of FIG. 6, and FIG. 10 is a plan sectional view of the centrifugal fan taken along line C-C' of FIG. 6.

Referring to FIGS. 2 to 10, a centrifugal fan 100 may include a hub 200 to which a rotation shaft of a motor is coupled, a shroud 400 disposed facing the hub 200, a guide member 500 which guides air introduced in an axial direction of the hub 200 to a circumferential direction of the hub 200, and a plurality of blades 300 separated from each other and disposed along the circumferential direction of the hub 200.

For convenience of description, a shroud 400 side refers to an upper side, and a hub 200 side refers to a lower side.

The hub 200 is formed roughly at the center of the centrifugal fan 100. The hub 200 may be formed to protrude from the lower side to the upper side, and a connection boss 210 connected to a rotation shaft of the driving motor may be formed at the center of the hub 200.

Additionally, the hub 200 is formed such that diameter widens from an upper end to a lower end and thus helps air introduced in the axial direction of the hub 200 to flow in the circumferential direction.

The plurality of blades 300 are disposed in two lines arranged in a radial direction around the hub 200, and include a plurality of first blades 310 disposed along the circumferential direction at regular gaps, and a plurality of second blades 320 disposed along the circumferential direction of the hub 200 at regular gaps while spaced a predetermined gap apart from the plurality of first blades 310 in the radial direction.

The shroud 400 is disposed facing the hub 200 and connected to upper ends of the outer edges of the plurality of second blades 320. The shroud 400 may include an inner diameter surface 410 which is formed roughly vertical, and an outer diameter surface 420 which is formed roughly horizontal.

The inner diameter surface 410 may form an inlet where air is introduced into the centrifugal fan 100, and the outer diameter surface 420 may form an outlet where the air is discharged from the centrifugal fan 100. The inner diameter surface 410 and the outer diameter surface 420 of the shroud 400 may be connected with a curved surface which widens as being directed toward the lower side such that air flows smoothly.

The guide member 500 is formed in a shape similar to the shroud 400 to help the air introduced into the inlet to change direction to the outlet, and is disposed between the shroud 400 and the hub 200.

The guide member 500 is formed in a ring shape, and may be formed by combining a planar region and a curved surface region such that the axially introduced air flow is naturally changed to the radial direction. Specifically, the guide member 500 may include an inlet-side planar region 510 into which air is introduced, an outlet-side planar region 530 from which the air is discharged, and a curved surface region 520 which connects the inlet-side planar region 510 to the outlet-side planar region 530.

A diameter Di of the inlet of the guide member 500 may be formed to be smaller than a diameter Do of the outlet of guide member 500, and the inlet-side planar region 510 and the curved surface region 520 may be formed such that diameters widen as being directed toward the lower side.

As illustrated in FIG. 8, an angle α of the inlet-side planar region 510 of the guide member 500 inclined with respect to a direction of the rotation shaft of the hub 200 may be in a range of −20° to 45°. An angle inclined to the center with respect to the direction of the rotation shaft of the hub 200 is defined as a positive (+) angle, and an angle inclined to the outside of the radial direction is defined as a negative (−) angle.

The outlet-side planar region 530 of the guide member 500 may be formed parallel with the outer diameter surface 420 of the shroud 400 forming the outlet of the centrifugal fan 100.

To design the guide member appropriately, the diameter Di of the inlet of the guide member 500 may be in a range of 20% to 80% of a total diameter D of the centrifugal fan 100, and the diameter Do of the outlet of the guide member 500 may be in a range of 30% to 90% of the total diameter D of the centrifugal fan 100.

Additionally, a height Hi of the inlet of the guide member 500 may be 120% or less of a total height Ht of the centrifugal fan 100, and a height Ho of the outlet of the guide member 500 may be 90% or less of an outlet height H of the centrifugal fan 100.

A diameter Dh of the hub 200 may be formed to be smaller than an inner diameter Di of the guide member 500, and an outer diameter Do of the guide member 500 may be formed to be smaller than an inner diameter Ds of the shroud 400. The shroud 400, the guide member 500, and the hub 200 are designed not to vertically overlap each other, and thus the shroud 400, the guide member 500, and the hub 200 may be simultaneously injected from a mold to integrally manufacture the centrifugal fan 100. When the centrifugal fan 100 is integrally manufactured, it is easy to manufacture, a high hardness can be achieved, and production costs can be reduced.

The guide member 500 is connected to the shroud 400 and connected to the hub 200 by the plurality of blades 300, the guide member 500 and the hub 200 are connected by the plurality of first blades 310, and the guide member 500 and the shroud 400 are connected by the plurality of second blades 320.

The plurality of second blades 320 include an upper side portion 321 and a lower side portion 322 with respect to the guide member 500, and the plurality of first blades 310 interact with the lower side portion 322 of the plurality of second blades 320, and thus contribute to an optimization of the inside pressure of the fan and the condition of the flow rate of air at the lower side of the guide member 500.

Since the flow rate of air at the upper side and the flow rate of the lower side of the guide member 500 are formed at different conditions, the plurality of second blades 320 have the upper side portion 321 and the lower side portion 322 which are formed with different shapes from each other.

In the plurality of blades 300, an edge of each blade 300 adjacent to the rotation shaft of the hub is referred to as a leading edge, an edge of each blade 300 adjacent to the outer diameter of the shroud is referred to as a trailing edge, a linear distance from the leading edge to the trailing edge is referred to as a code length, and each code length CU1 of upper ends of the plurality of first blades 310 may be formed to be smaller than each code length CL1 of lower ends of the plurality of first blades 310, the code length of the first blade 310 may be formed to be continuously increased from the upper end to the lower end along the inlet-side planar region 510 and the curved surface region 520 of the guide member 500. Meanwhile, each code length CU2 of the upper side portion 321 of the plurality of second blades 320 may be formed to be greater than or equal to each code length CL2 of the lower side portion 322.

Additionally, the leading edges of the plurality of second blades 320 are divided into upper side-leading edges 324 and lower side-leading edges 325 by the guide member 500, and thus an inlet angle β1 of the upper side portion 321 and an inlet angle β2 of the lower side portion 322 may be different from each other. Meanwhile, trailing edges 323 of the plurality of second blades 320 is not divided by the guide member 500, and thus an outlet angle γ of the upper side portion 321 and an outlet angle γ of the lower side portion 322 may be the same.

In a centrifugal fan according to one embodiment of the present disclosure, a height B1 of the first blades 310 may be formed to be smaller than a height B2 of the second blades 320. Additionally, the height B1 of the first blades 310 may be formed to correspond to the height Hi of the inlet of the guide member 500.

Figure 11:
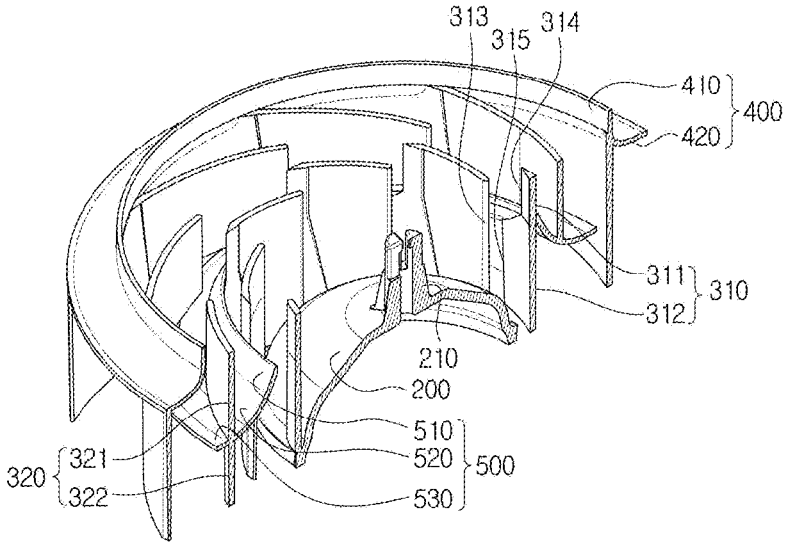
FIG. 11 is a sectional perspective view illustrating a centrifugal fan according to another embodiment of the present disclosure.
Figure 12:
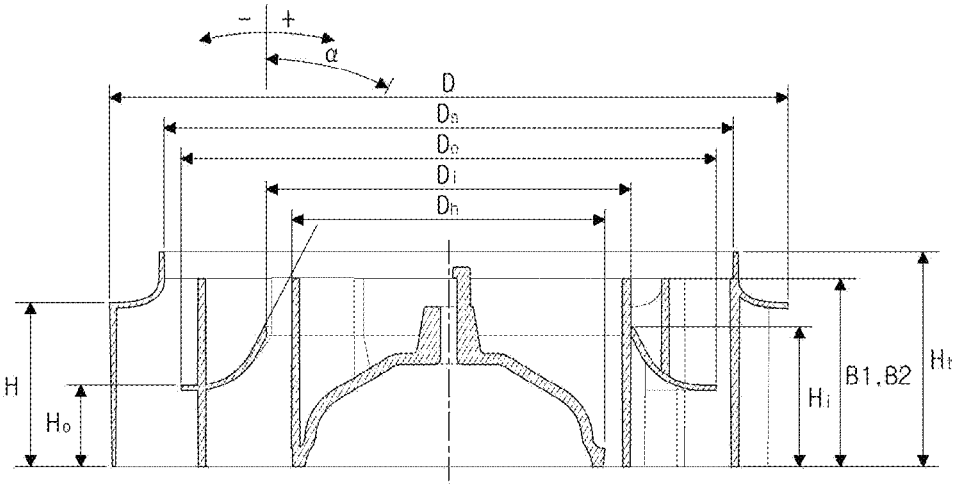
FIG. 12 is a side sectional view illustrating the centrifugal fan shown in FIG. 11.

FIG. 11 is a sectional perspective view of a centrifugal fan according to another embodiment of the present disclosure, and FIG. 12 is a side sectional view of the centrifugal fan of FIG. 11.

Referring to FIGS. 11 and 12, in a centrifugal fan 100, each height B1 of first blades 310 may be formed to be the same as each height B2 of second blades 320. In other words, each height B1 of the first blades 310 may be formed to be greater than a height Hi of an inlet of a guide member 500.

Even though not illustrated in the figure, in a centrifugal fan according to the aspect of the present disclosure, the height B1 of the first blade 310 may be formed to be greater than the height B2 of the second blade 320, preferably the height B1 of the first blade 310 may be formed to be in the range of more than 100% and 150% or less of the height B2 of the second blade 320, more preferably the height B1 of the first blade 310 may be formed to be in the range of more than 100% and 120% or less of the height B2 of the second blade 320.

When the height B1 of the first blade 310 is formed to be greater than or equal to the height B2 of the second blade 320, the plurality of first blades 310 may be divided into upper side portions 311 and lower side portions 312 based on the height Hi of the inlet of the guide member 500.

A code length CU1 of the upper side portion 311 of the first blades 310 may be formed to be smaller than a code length CL1 of the lower side portion 312, and the code length CL1 of the lower side portion 312 of the first blades 310 may be formed to be continuously increased from the upper end to the lower end along an inlet-side planar region 510 and a curved surface region 520 of the guide member 500.

Additionally, trailing edges of the plurality of first blades 310 are divided into upper side-trailing edges 314 and lower side-trailing edges 315 by the guide member 500, and thus, contrary to the plurality of second blades 320, an outlet angle of the upper side portion 311 and an outlet angle of the lower side portion 312 may be different from each other. Meanwhile, because leading edges 313 of the plurality of first blades 310 are not divided by the guide member 500, an inlet angle of the upper side portion 311 and an inlet angle of the lower side portion 312 may be the same. The centrifugal fan according to the aspect of the present disclosure may include a plurality of guide members, and the centrifugal fan according to the aspect of the present disclosure may include a plurality of blades disposed in three or more arrays in a radial direction.

Figure 13:
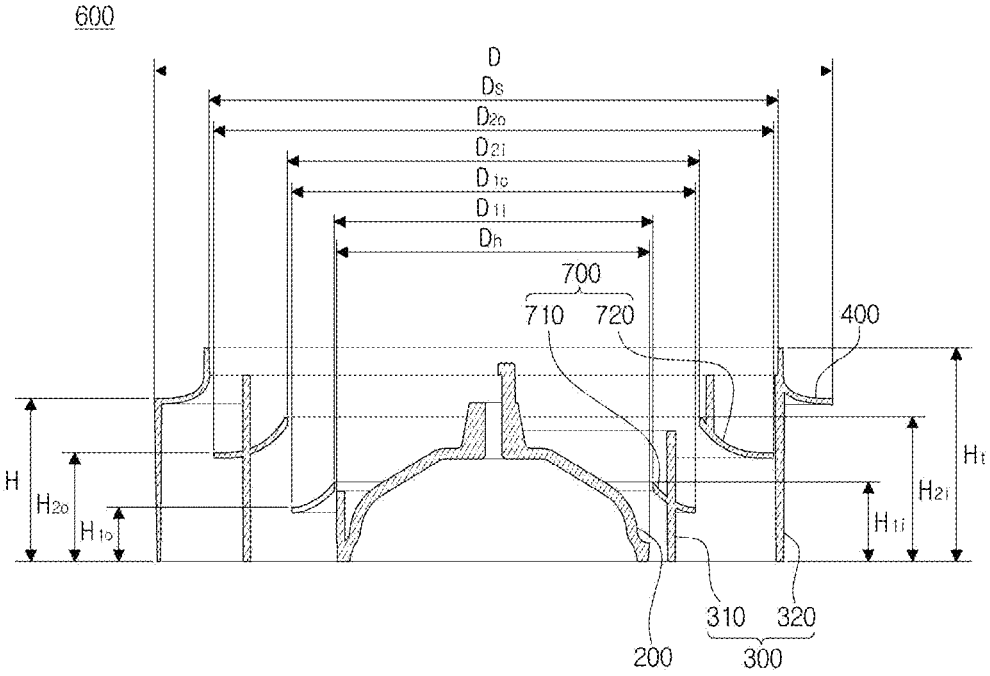
FIG. 13 is a side sectional view illustrating a centrifugal fan according to still another embodiment of the present disclosure.

FIG. 13 is a side sectional view of a centrifugal fan according to still another embodiment of the present disclosure.

Referring to FIG. 13, a centrifugal fan 600 is different from the centrifugal fan 100 shown in FIG. 2 in that the centrifugal fan 600 has a plurality of guide members 700, and the other constitutions are provided in the same way. Hereinafter, a description will be given only for the differences with the centrifugal fan 100 shown in FIG. 2 and descriptions of duplicate constitutions will be omitted.

The plurality of guide members 700 are disposed between the shroud 400 and the hub 200, a first guide member 710 is disposed at the hub 200, and a second guide member 720 is disposed at the shroud 400.

The plurality of guide members 700 are formed in a ring shape and may be formed by combining a planar region and a curved surface region such that axially introduced air flow is naturally changed to a radial direction.

In the plurality guide members 700, diameters D1*i* and D2*i* of inlets may be formed to be smaller than diameters D1*o* and D2*o* of outlets, and a diameter Dh of the hub 200 may be formed to be smaller than an inner diameter D1*i* of the first guide member 710, and an inner diameter D2*i* of the second guide member 720 may be formed to be greater than an outer diameter D1*o* of the first guide member 710. Additionally, an outer diameter D2*o* of the second guide member 720 may be formed to be smaller than the inner diameter Ds of the shroud 400.

The shroud 400, the plurality of guide members 500, and the hub 200 are designed not to vertically overlap each other, and thus the shroud 400, the plurality of guide members 500, and the hub 200 are simultaneously injected from a mold to integrally manufacture the centrifugal fan 600. When the centrifugal fan 600 is integrally manufactured, it is easy to manufacture, a high hardness can be achieved, and production costs can be reduced.

Heights H1*i* and H2*i* of the inlets of the plurality of guide members 700 may be appropriately formed in the range of 120% or less of a total height Ht of the centrifugal fan 600, and heights H1*o* and H2*o* of the outlets of the plurality of guide members 700 may be appropriately formed in the range of 90% or less of a height H of an outlet of the centrifugal fan. However, the height H1*o* of the outlet of the first guide member 710 may be formed to be smaller than the height H2*o* of the outlet of the second guide member 720.

The plurality of guide members 700 are connected to the shroud 400 or the hub 200 by the plurality of blades 300, and the first guide member 710 and the hub 200 are connected by the plurality of first blades 310, and the second guide member 720 and the shroud 400 connected by the plurality of second blades 320.

Since the inside pressures of the fan and the conditions of air flow rate are formed differently between the upper side and the lower side of the plurality of first blades 310 with respect to the first guide member 710, the shapes of an upper side portion and a lower side portion of the first guide member 710 may be formed differently from each other, and since the inside pressures of the fan and the conditions of air flow rate are formed differently between the upper side and the lower side of the plurality of second blades 320 with respect to the second guide member 720, the shapes of an upper side portion and a lower side portion of the second guide member 720 may be formed differently from each other.

The upper side portions of the plurality of first blades 310 interact with the lower side portions of the plurality of second blades 320, and thus contribute to an optimization of the inside pressure and the air flow rate of the fan.

The centrifugal fan according to the aspect of the present disclosure may configure a centrifugal fan assembly using a motor for driving the centrifugal fan and a bracket in which the motor is installed.

Figure 14:
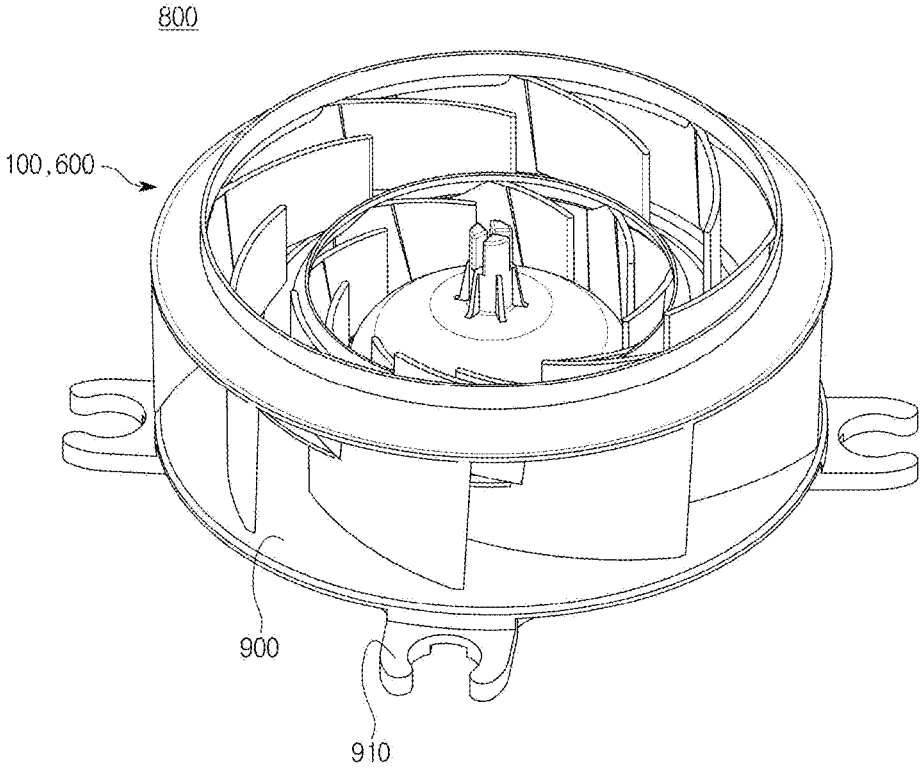
FIG. 14 is a perspective view illustrating an exterior of a centrifugal fan assembly according to one embodiment of the present disclosure when viewed from the top.
Figure 15:
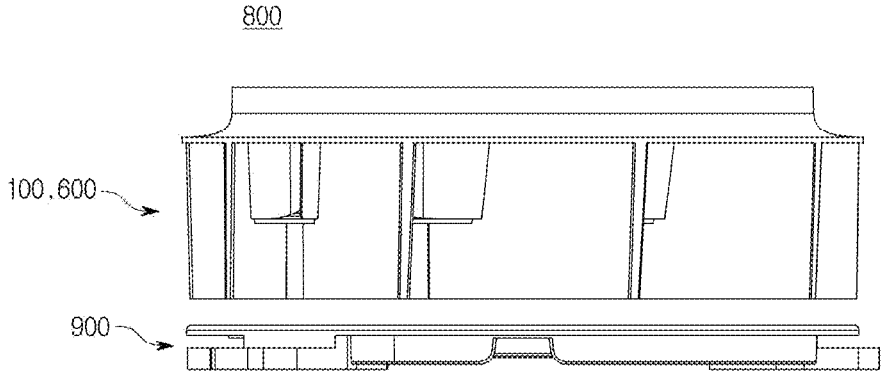
FIG. 15 is a side view illustrating the centrifugal fan assembly shown in FIG. 14.

FIG. 14 is a perspective view of an exterior of a centrifugal fan assembly according to one embodiment of the present disclosure when viewed from the top, and FIG. 15 is a side view of the centrifugal fan assembly of FIG. 14.

Referring to FIGS. 14 and 15, a centrifugal fan assembly 800 may include the centrifugal fan 100 or 600, a motor (not shown) as a driving unit for rotating the centrifugal fan 100 or 600, and a bracket 900 in which the motor is installed.

The bracket 900 is formed in a roughly disc shape and may include at least one coupling unit 910 to couple the centrifugal fan assembly 800 to another member. Therefore, the bracket 900 may serve to fix the motor and the centrifugal fan 100 or 600, and may also serve to fix the centrifugal fan assembly 800 to another member.

Additionally, the bracket 900 is disposed to be spaced a certain distance apart from a lower part of the centrifugal fan 100 or 600, and serves to help reduce a loss of flow rate when air axially induced in the centrifugal fan 100 or 600 is discharged in a radial direction by changing the direction.

The centrifugal fan according to the aspect of the present disclosure can be applied to various home appliances, such as refrigerators, air conditioners, cooking devices, etc., because the centrifugal fan has a high efficiency with low noise.

Figure 16:
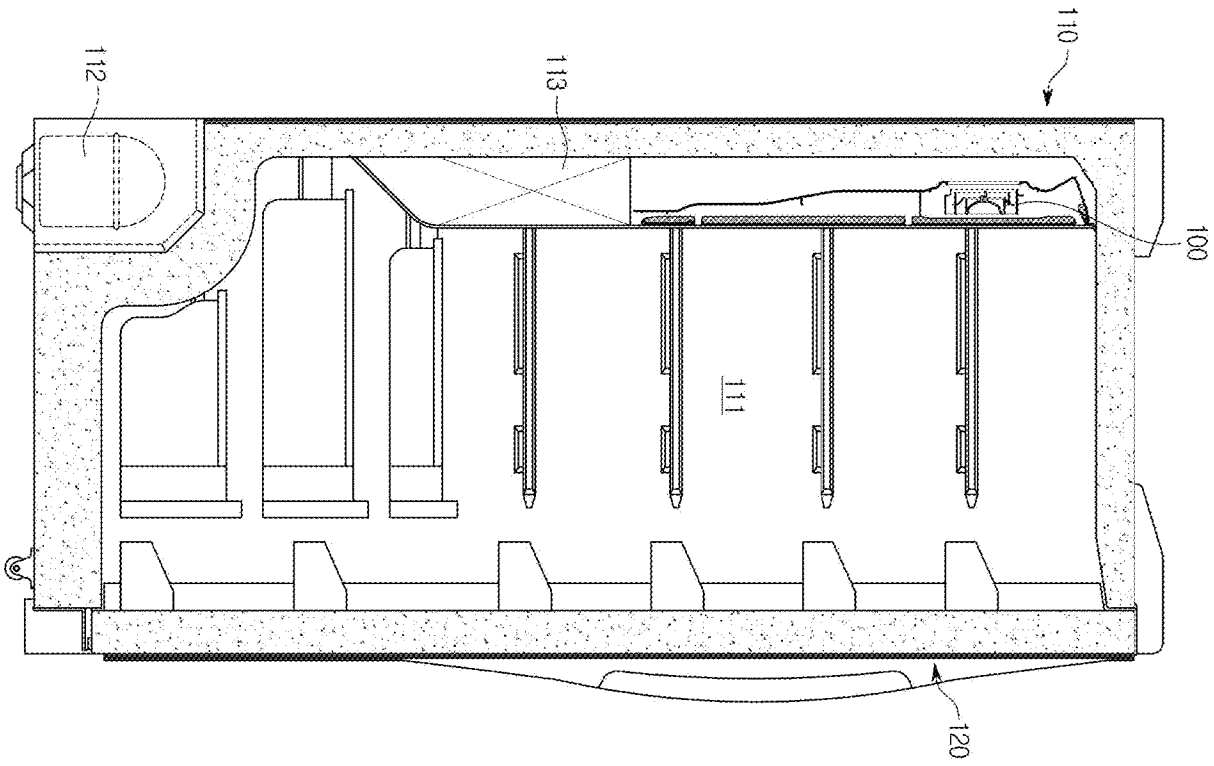
FIG. 16 is a sectional view of a refrigerator according to one embodiment of the present disclosure.

FIG. 16 is a sectional view of a refrigerator according to one embodiment of the present disclosure.

Referring to FIG. 16, the refrigerator according to one embodiment of the present disclosure includes a main body 110 forming an exterior of the refrigerator and provided with a storage chamber 111 in which food is stored, and a door 120 rotatably hinge-coupled to the main body 110 at one end thereof to open and close the storage chamber 111. In the embodiment, the storage chamber 111 is vertically partitioned into one side forming a freezing chamber storing goods in a frozen state and the other side forming a refrigerating chamber for storing goods in a refrigerated state, and the door 120 is provided as one pair to open and close the storage chamber 111 divided into the refrigerating chamber and the freezing chamber, respectively.

Additionally, components for a refrigerating cycle, such as a compressor 112 for compressing a refrigerant, a condenser (not shown) for cooling the refrigerant to exchange heat with air outside of the main body 110, an expansion valve (not shown) for decompressing and expanding the refrigerant, an evaporator 113 disposed behind the storage chamber 111 and generating cold air by absorbing heat from air inside the storage chamber 111, etc., are installed in the main body 110.

Food stored in the storage chamber 111 may be maintained at a low temperature by the cold air generated from the evaporator 113, and the cold air generated from the evaporator 113 is blown by the centrifugal fan 100 according to the aspect of the present disclosure to be circulated inside the storage chamber 111.

As is apparent from the above description, the centrifugal fan according to the spirit of the present disclosure includes a middle guide member inducing inflow in the middle of the fan, thereby decreasing a loss of air flow occurring in the course of axial flow being changed to a rotational flow in a radial direction.

Additionally, the centrifugal fan according to the aspect of the present disclosure includes a middle guide member inducing inflow in the middle of the fan, and thus inflow to the fan is prevented from being concentrated in a lower part of the fan, and a total height of a discharge port can be efficiently used. Therefore, the uniformity of a discharging flow at the discharge port is improved, and thus noise of fan can be reduced.

Additionally, the centrifugal fan according to the aspect of the present disclosure can have a structure in which a fan having a guide member can be easily and integrally manufactured in a mold.

Additionally, the centrifugal fan according to the aspect of the present disclosure having a structure in which a plurality of blades disposed along a circumferential direction are disposed in two lines arranged in a radial direction of a hub, and thus the noise of fan can be reduced and the flow rate of air is increased, and the efficiency of the fan can be improved.

While the technological idea of the present disclosure has been described with specific embodiments, the scope of the present disclosure is not limited by the embodiments.

The scope of the present disclosure encompasses various embodiments that may be modified or changed by those skilled in the art without departing from the spirit and scope of the disclosure.

What is claimed is:

1. A centrifugal fan comprising:

a hub to which a rotation shaft of a motor is coupled;

a shroud disposed facing the hub;

a guide member disposed between the shroud and the hub to change a flow direction of air introduced in an axial direction of the hub to a circumferential direction of the hub, the guide member separately disposed to be separate from the hub;

a plurality of first blades separated from each other and disposed along the circumferential direction of the hub; and a plurality of second blades disposed to be separated from each other along the circumferential direction of the hub, while disposed to be separated from the plurality of first blades in a radial direction of the hub, wherein the guide member is connected to the hub by the plurality of first blades, and wherein the guide member is connected to the shroud by the plurality of second blades.

2. The centrifugal fan according to claim 1, wherein a diameter of the hub is smaller than an inner diameter of the guide member.

3. The centrifugal fan according to claim 1, wherein the guide member includes:

an inlet-side planar region into which air is introduced;

an outlet-side planar region from which the air is discharged; and a curved surface region which connects the inlet-side planar region to the outlet-side planar region.

4. The centrifugal fan according to claim 3, wherein an angle of the inlet-side planar region of the guide member inclined with respect to a direction of the rotation shaft of the hub is in a range of −20° to 45°.

5. The centrifugal fan according to claim 1, wherein a diameter of an inlet of the guide member is smaller than a diameter of an outlet of the guide member.

6. The centrifugal fan according to claim 5, wherein the diameter of the inlet of the guide member is in a range of 20% to 80% of a total diameter of the centrifugal fan.

7. The centrifugal fan according to claim 5, wherein the diameter of the outlet of the guide member is in a range of 30% to 90% of a total diameter of the centrifugal fan.

8. The centrifugal fan according to claim 1, wherein a height of an inlet of the guide member is 120% or less of a total height of the centrifugal fan.

9. The centrifugal fan according to claim 1, wherein a height of an outlet of the guide member is 90% or less of a height of an outlet of the centrifugal fan.

10. The centrifugal fan according to claim 1, wherein an outer diameter of the guide member is smaller than an inner diameter of the shroud.

11. The centrifugal fan according to claim 1, wherein each of the plurality of second blades includes one side and an other side with respect to the guide member, and the one side and the other side are formed in different shapes from each other.

12. The centrifugal fan according to claim 11, wherein a code length of the one side is greater than or equal to a code length of the other side.

13. The centrifugal fan according to claim 11, wherein an inlet angle of the one side and an inlet angle of the other side are different from each other, and an outlet angle of the one side and an outlet angle of the other side are the same.

14. A centrifugal fan comprising:

a hub to which a rotation shaft of a motor is coupled;

a shroud disposed facing the hub;

at least one guide member disposed vertically between the shroud and the hub to change a flow direction of air introduced in an axial direction of the hub to a circumferential direction outward of the hub, the at least one guide member separately disposed to be separate from the hub and the shroud; and a plurality of blades disposed to be separated from each other along the circumferential direction of the hub.

15. The centrifugal fan according to claim 14, wherein a diameter of the hub is smaller than an inner diameter of a guide member that is smallest among the at least one guide member.

16. The centrifugal fan according to claim 14, wherein among the at least one guide member, an inner diameter of a guide member of a shroud-side among the at least one guide member is greater than an outer diameter of a guide member of a hub-side among the at least one guide member.

17. The centrifugal fan according to claim 14, wherein the at least one guide member is connected to the shroud or the hub by the plurality of blades.

18. The centrifugal fan according to claim 14, wherein an outer diameter of the at least one guide member is smaller than an inner diameter of the shroud.

* * * * *